US006736733B2

(12) United States Patent
Yu

(10) Patent No.: US 6,736,733 B2
(45) Date of Patent: May 18, 2004

(54) ON BILLIARD CUE

(76) Inventor: Kuo-Pin Yu, No. 6, Lane 477, Sec. 2, Feng-Shyn Rd., Feng Yuan City, Taichung Hsien (TW)

( * ) Notice: Subject to any disclaimer, the term of this patent is extended or adjusted under 35 U.S.C. 154(b) by 0 days.

(21) Appl. No.: 10/067,799

(22) Filed: Feb. 8, 2002

(65) Prior Publication Data

US 2002/0072424 A1 Jun. 13, 2002

Related U.S. Application Data

(63) Continuation of application No. 09/604,738, filed on Jun. 28, 2000, now abandoned.

(51) Int. Cl.[7] ..... A63D 15/08
(52) U.S. Cl. ..... 473/44
(58) Field of Search ..... 473/44–49

(56) References Cited

U.S. PATENT DOCUMENTS

| | | | | | |
|---|---|---|---|---|---|
| 3,368,271 | A | * | 2/1968 | Scheffler | 473/44 |
| 3,468,538 | A | * | 9/1969 | Johnson | 473/44 |
| 4,931,124 | A | * | 6/1990 | Baum | 156/245 |
| 6,110,051 | A | * | 8/2000 | McCarty et al. | 473/44 |
| 6,358,166 | B1 | * | 3/2002 | Yu | 473/561 |

FOREIGN PATENT DOCUMENTS

| | | | | |
|---|---|---|---|---|
| CA | 726578 | * | 1/1966 | 473/44 |
| GB | 2060411 | * | 5/1981 | 473/44 |
| GB | 2187646 | * | 9/1987 | 473/44 |
| GB | 2209681 | * | 5/1989 | 473/44 |
| GB | 2270633 | * | 3/1994 | 473/44 |

* cited by examiner

*Primary Examiner*—Mark S. Graham
(74) *Attorney, Agent, or Firm*—Browdy and Neimark, P.L.L.C.

(57) ABSTRACT

A billiard cue has a main body formed of one or more segments which are connected end to end. At least one segment consists of an outer casing which is made of a fiber-reinforced plastic material and is covered with a wooden sheath and a protective layer. The billiard cue is not prone to deformation and is provided with appearance of a wood texture.

13 Claims, 3 Drawing Sheets

ON BILLIARD CUE

This application is a continuation of Ser. No. 09/604,738, Jun. 28, 2000, abandoned.

FIELD OF THE INVENTION

The present invention relates generally to a billiard cue, and more particularly to a billiard cue which is made of a fiber-reinforced plastic material and is covered with a wooden sheath for lending the wood texture to the billiard cue.

BACKGROUND OF THE INVENTION

The billiard cue of a wooden material is vulnerable to deformation due to the climatic factors as well as the ageing of the wooden material. The billiard cue of a fiber-reinforced plastic material is free from the deficiencies of the wooden billiard cue described above; nevertheless the billiard cue made of the fiber-reinforced plastic material lacks wooden texture of surface characteristic of the wooden material.

SUMMARY OF THE INVENTION

It is therefore the primary objective of the present invention to provide an improved billiard cue with wooden texture of surface characteristic of the wooden material. The billiard cue is not vulnerable to deformation caused by the ageing of the billiard cue as well as the climatic factors.

It is another objective of the present invention to provide an improved billiard cue which is made of a fiber-reinforced plastic material, so as to reduce the consumption of the timber resource.

It is still another objective of the present invention to provide an improved billiard cue which is versatile in structure and appearance.

It is still another objective of the present invention to provide an improved billiard cue with a shock-absorbing means.

In keeping with the principle of the present invention, the foregoing objectives of the present invention are attained by a billiard cue having a rodlike main body. The main body is made up of one segment or a plurality of segments. At least one segment consists of an outer casing of a fiber reinforced plastic material, a wooden sheath covering the outer casing, and a protective layer covering said wooden sheath. The billiard cue is not vulnerable to deformation and is provided with texture which are characteristic of a wooden material. In the meantime, the billiard cue of the present invention makes contribution to the timber conservation.

The main body of the billiard cue of the present invention is versatile in construction in that the main body may be made up of a plurality of segments which are made of a fiber-reinforced plastic material, and a plurality of segments which are made of a wooden material and arranged alternately with the segments of the fiber-reinforced plastic material.

The main body of the billiard cue of the present invention is provided with a shock-absorbing body which is made of a plastic foam material and is disposed in one of the segments.

The foregoing objectives, features, functions, and advantages of the present invention will be more readily understood upon a thoughtful deliberation of the following detailed description of the embodiments of the present invention with reference to the accompanying drawings.

DETAILED DESCRIPTION OF THE INVENTION

Figure 1:
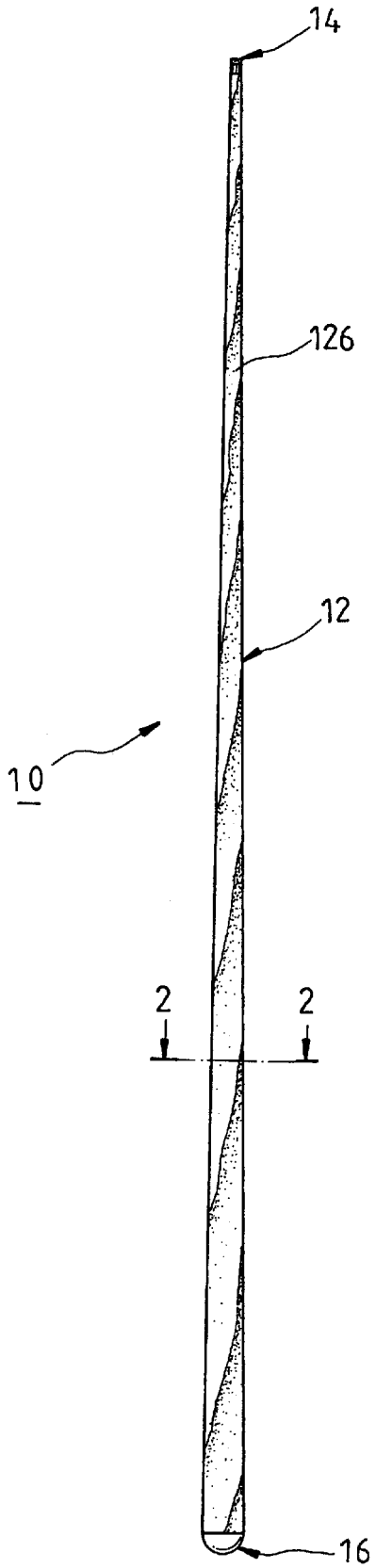
FIG. 1 shows a front view of a first preferred embodiment of the present invention.
Figure 2:
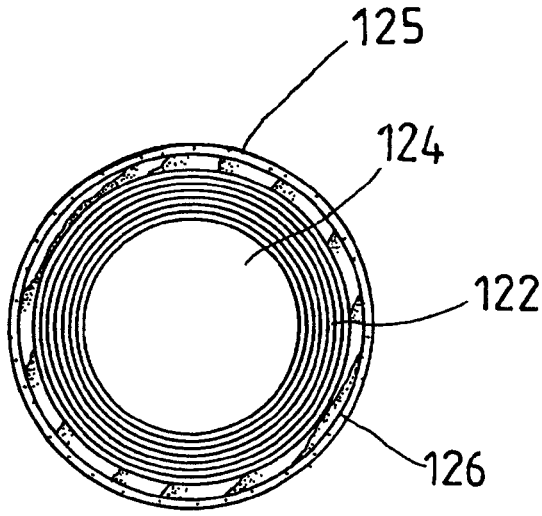
FIG. 2 shows a sectional view taken along the direction indicated by a line 2—2 as shown in FIG. 1.

As shown in FIGS. 1 and 2, a billiard cue 10 of the first preferred embodiment of the present invention has a rodlike main body 12 of a tapered construction. The main body 12 is provided at the tip thereof with a leather head 14 fastened therewith, and at the bottom end thereof with a bumper 16.

The main body 12 is formed of only one segment and has an outer casing 122 which is made of a thermoplastic or thermosetting fiber-reinforced plastic material, such as a plurality of carbon fiber fabric plates which are preimpregnated with epoxy resin and stacked together before being wound. The main body 12 further has a hollow interior 124, and a wooden sheath 126 covering the main body 12 and made of a wooden material, such as a thin wooden skin, a thin bamboo skin, a wooden film, a bamboo film, etc.

The wooden sheath 126 covers the whole surface of the outer casing 122. In fabrication, the wooden sheath 126 is wound round the outer casing 122 and fixedly adhered to the surface of the outer casing 122. According to the present preferred embodiment, the thickness of the wooden sheath 126 is about 0.1 mm. However, it is acceptable to have the thickness of the wooden sheath 126 within the range of 0.05 mm~1.0 mm.

Furthermore, there is a protective layer 125 covering said wooden sheath. The protective layer 125 is made of transparent or semitransparent fiber material, for example, nonwoven fabric, fiber reinforced plastic film, or epoxy resin-coated fiberglass film, and covered over the whole surface of the wooden sheath 126. The presence of the protective layer 125 protects the wooden sheath 126 against impact of external objects, without keeping the color pattern of the wooden sheath 126 from sight.

Figure 3:
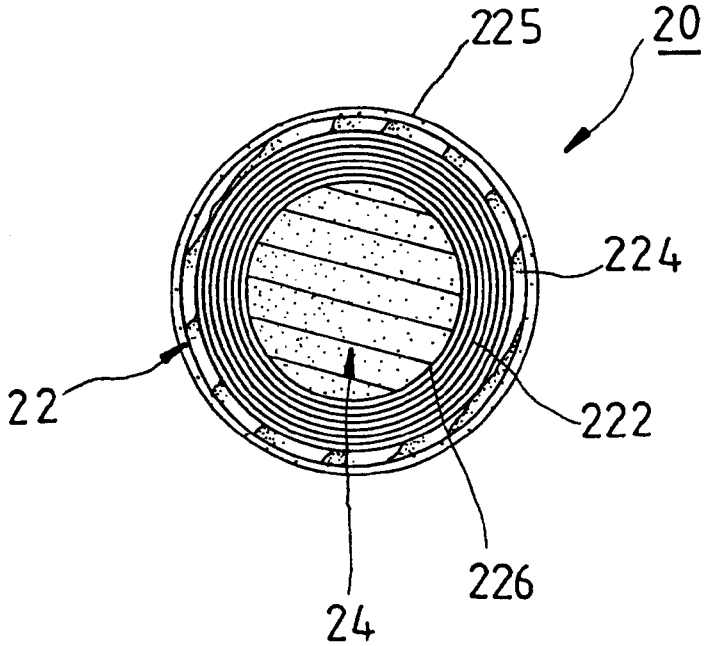
FIG. 3 shows a sectional view of a second preferred embodiment of the present invention, with the sectional view being taken along the direction similar to that of FIG. 2.

As shown in FIG. 3, a billiard cue 20 of the second preferred embodiment of the present invention has a rodlike main body 22 with an outer casing 222 of a fiber-reinforced plastic material, a wooden sheath 224, a protective layer 225, and a hollow interior 226 in which a core 24 of a PU foam material is disposed.

Figure 4:
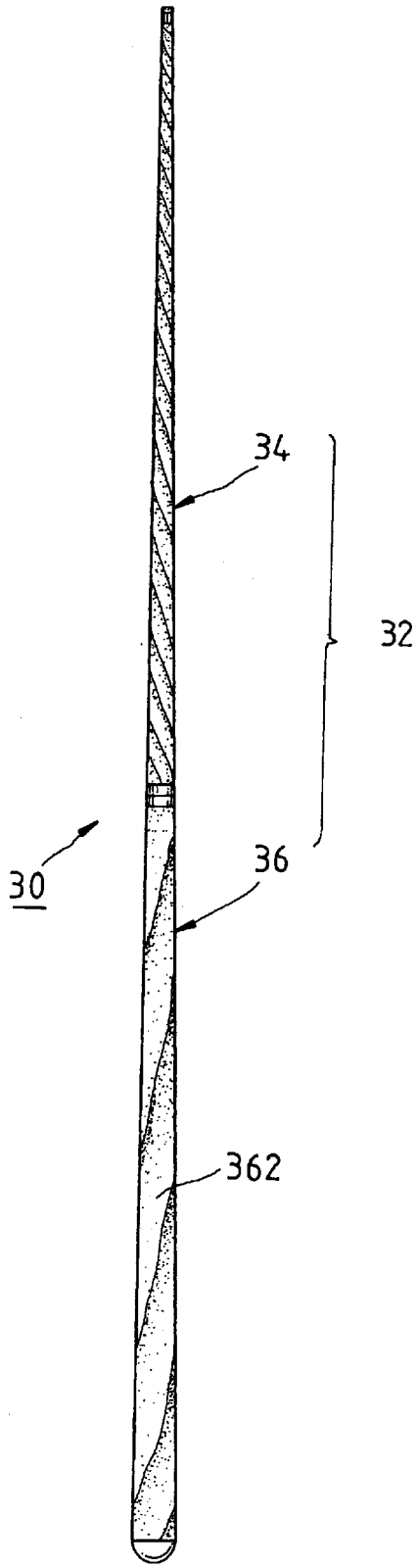
FIG. 4 shows a front view of a third preferred embodiment of the present invention.

As shown in FIG. 4, a billiard cue 30 of the third preferred embodiment of the present invention has a rodlike main body 32 consisting of a first segment 34 and a second segment 36, which are connected end to end. The first segment 34 is made of a wooden material. The second segment 36 has an outer casing (not shown in the drawing) of a fiber-reinforced plastic material, a wooden sheath 362 covering the outer casing, and a protective layer (not been seen in the drawing) covering said wooden sheath 362. The first segment 34 and the second segment 36 are fastened detachably or undetachably. The main body 32 is of a tapered construction such that the first segment 34 is smaller in diameter than the second segment 36, or vice versa.

Figure 5:
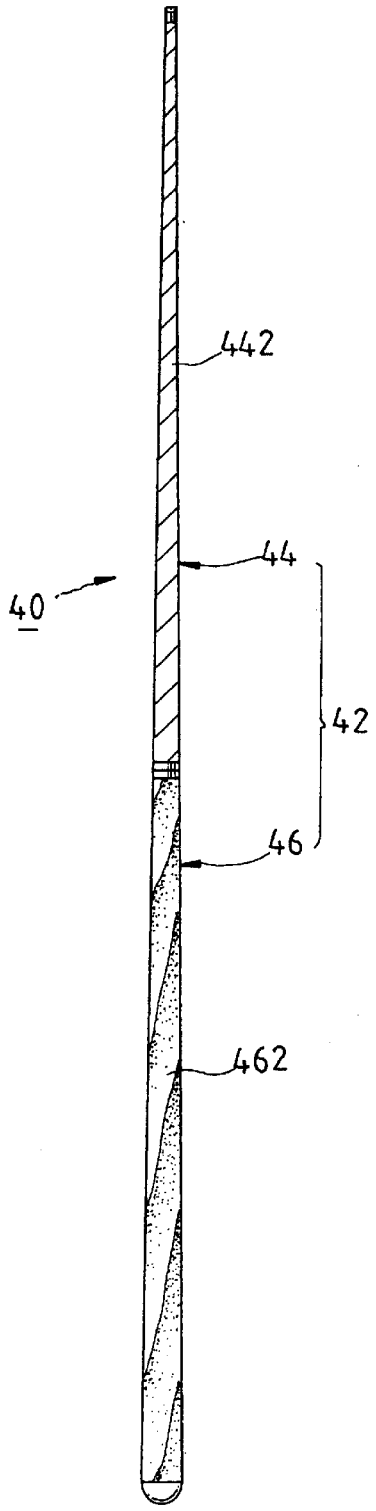
FIG. 5 shows a front view of a fourth preferred embodiment of the present invention.

As shown in FIG. 5, a billiard cue 40 of the fourth preferred embodiment of the present invention has a rodlike main body 42 formed of two segments which are connected end to end. The first segment 44 has an outer casing 442 which is made of a thermoplastic or thermosetting fiber-reinforced plastic material and is devoid of a wooden sheath covering the periphery thereof. The second segment 46 has an outer casing (not shown in the drawing) which is made of a thermoplastic or thermosetting fiber-reinforced plastic material and is covered with a wooden sheath 462 and a protective layer (not been seen in the drawing) covering said wooden sheath 462. The first segment 44 and the second segment 46 are interchangeable in position.

Figure 6:
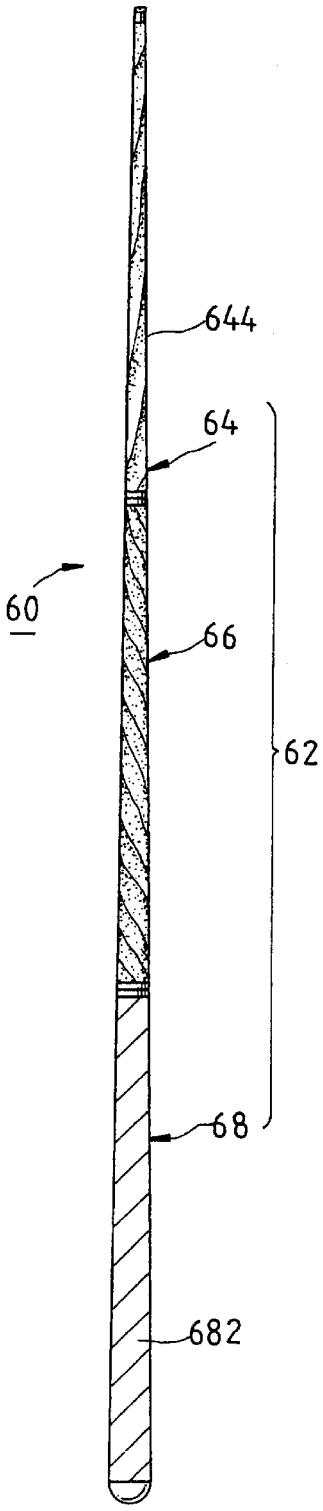
FIG. 6 shows a front view of a fifth preferred embodiment of the present invention.

As shown in FIG. 6, a billiard cue 60 of the fifth preferred embodiment of the present invention has a rodlike main body 62 formed of three segments which are connected end to end. The first segment 64 has an outer casing (not shown in the drawing) which is made of a fiber-reinforced plastic material and is covered with a wooden sheath 644 and a protective layer (not been seen in the drawing) covering said wooden sheath. The second segment 66 is made of a wooden material. The third segment 68 has an outer casing 682 of a fiber-reinforced plastic material. These three segments are different in diameter and interchangeable in position. The fiber-reinforced plastic material of which the outer casings of the main body 62 are made may be either thermoplastic or thermosetting.

Figure 7:
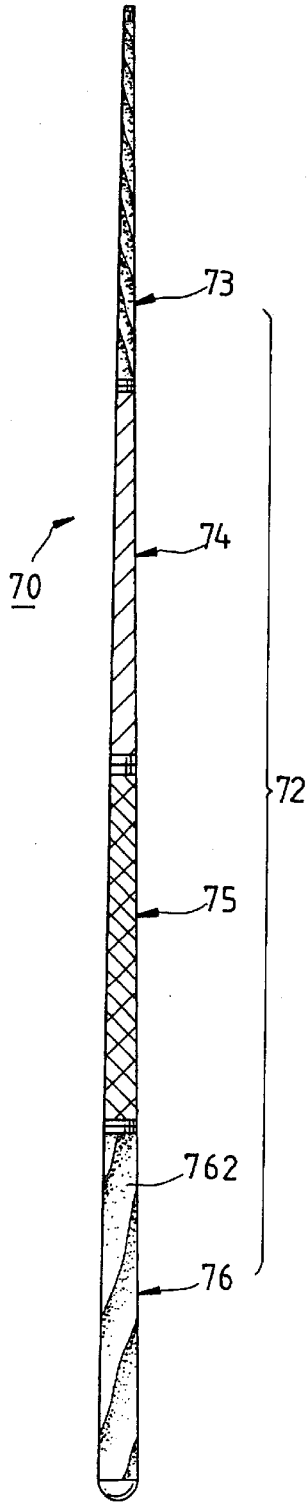
FIG. 7 shows a front view of a sixth preferred embodiment of the present invention.

As shown in FIG. 7, a billiard cue 70 of the sixth preferred embodiment of the present invention has a rodlike main body 72 formed of four segments which are connected end to end. The first segment 73 is made of a wooden material. The second segment 74 has an outer casing which is made of a thermoplastic reinforced plastic material. The third segment 75 has an outer casing of a thermosetting reinforced plastic material. The fourth segment 76 has an outer casing which is made of a thermoplastic or thermosetting fiber-reinforced plastic material and is covered with a wooden sheath 762 and a protective layer (not been seen in the drawing). These four segments form the main body 72 having a large diameter, an intermediate diameter, and a small diameter.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A billiard cue comprising:

a tapered main body having an outer casing made of a fiber-reinforced plastic material, and a hollow interior extending along the direction of a longitudinal axis of said main body;

a wooden sheath covering said outer casing; and a protective layer covering said wooden sheath; and wherein said protective layer is made of non-woven fabrics or glass fiber reinforced plastics.

2. The billiard cue as defined in claim 1, wherein said hollow interior is filled with a rod made of a foam material.

3. The billiard cue as defined in claim 1, wherein said main body is made up of at least two segments connected end to end.

4. The billiard cue as defined in claim 3, wherein at least one of said two segments has a hollow interior which is filled with a rod made of a foam material.

5. A billiard cue comprising:

a tapered main body formed of at least two segments connected end to end, with one of said two segments being made of a wooden material, with another one of said two segment having an outer casing of a fiber-reinforced plastic material, a hollow interior, a wooden sheath covering said outer casing, and a protective layer covering said wooden sheath; and wherein said protective layer is made of non-woven fabrics or glass fiber reinforced plastics.

6. The billiard cue as defined in claim 5, wherein said hollow interior is filled with a rod made of a foam material.

7. A billiard cue comprising:

a tapered main body formed of at least two segments connected end to end, with one of said two segments having an outer casing of a fiber-reinforced plastic material and a hollow interior, with another of said two segments having an outer casing of a fiber-reinforced plastic material, a hollow interior, a wooden sheath covering said outer casing, and a protective layer covering said wooden sheath; and wherein said protective layer is made of non-woven fabrics or glass fiber reinforced plastics.

8. The billiard cue as defined in claim 7, wherein at least one said two segments is provided with a rod which is filled in said hollow interior thereof and is made of a foam material.

9. A billiard cue comprising a tapered main body formed of at least three segments connected end to end, with a first segment of said three segments having an outer casing of a fiber-reinforced plastic material, a hollow interior, a wooden sheath covering said outer casing, and a protective layer covering said wooden sheath, with a second segment of said three segments being made of a wooden material, and with a third segment of said three segments having an outer casing of a fiber-reinforced plastic material, and a hollow interior; and wherein said protective layer is made of non-woven fabrics or glass fiber reinforced plastics.

10. The billiard cue as defined in claim 9, wherein at least one said hollow interior of said first segment and said third segment is filled with a rod made of a foam material.

11. A billiard cue comprising a tapered main body formed of at least four segments connected end to end, with a first segment of said four segments being made of a wooden material, with a second segment of said four segments having an outer casing of a fiber-reinforced plastic material, a hollow interior, a wooden sheath covering said outer casing, and a protective layer covering said wooden sheath, with a third segment of said four segments having an outer casing of a thermoplastic fiber-reinforced plastic material, and a hollow interior, and with a fourth segment of said four segments having an outer casing of a thermosetting fiber-reinforced plastic material, and a hollow interior; and wherein said protective layer is made of non-woven fabrics or glass fiber reinforced plastics.

12. The billiard cue as defined in claim 11, wherein at least one said hollow interior of said second segment, said third segment and said fourth segment is filled with a rod made of a foam material.

13. A billiard cue comprising a tapered main body having an outer casing of a fiber-reinforced plastic material, a hollow interior, a wooden sheath covering at least one segment of said outer casing, and a protective layer covering said outer casing and said wooden sheath; and wherein said protective layer is made of non-woven fabrics or glass fiber reinforced plastics.

* * * * *